United States Patent [19]

Triebel

[11] 4,096,642

[45] Jun. 27, 1978

[54] APPARATUS FOR HEAT EXCHANGE BETWEEN FINE MATERIAL AND GAS

[75] Inventor: Wolfgang Triebel, Oelde, Germany

[73] Assignee: Polysius, AG, Neubeckum, Germany

[21] Appl. No.: 749,473

[22] Filed: Dec. 10, 1976

[30] Foreign Application Priority Data

Jan. 19, 1976 Germany ..... 2601776

[51] Int. Cl.[2] ..... F26B 17/00

[52] U.S. Cl. ..... 34/57 R; 34/57 A; 432/58; 432/106

[58] Field of Search ..... 432/14, 15, 58, 106; 34/57 A, 57 R

[56] References Cited

U.S. PATENT DOCUMENTS

| | | | |
|---|---|---|---|
| 3,423,840 | 1/1969 | Beeken | 432/15 |
| 3,910,754 | 10/1975 | Weber et al. | 34/57 R |
| 4,025,295 | 5/1977 | Touborg | 34/57 A |
| 4,035,139 | 7/1977 | Goldmann et al. | 432/58 |

*Primary Examiner*—John J. Camby

*Attorney, Agent, or Firm*—Marshall & Yeasting

[57] ABSTRACT

A vertical reaction vessel has a plurality of funnel-like constrictions dividing the vessel into individual chambers, at least one inlet for introducing fine material into the top of the uppermost of such chambers, and an opening at the bottom of the lowermost of such chambers for withdrawing heated fine material, and for introducing hot gas to be exhausted from the uppermost chamber. Guide elements for the fine material extend downward along the inner surface of at least one of the funnel-like constrictions.

8 Claims, 5 Drawing Figures

APPARATUS FOR HEAT EXCHANGE BETWEEN FINE MATERIAL AND GAS

BACKGROUND OF THE INVENTION

The invention relates to an apparatus for heat exchange between fine material and gas consisting substantially of a vertical reaction space which is divided by a plurality of funnel-like cross-section constrictions into individual chambers, the fine material being introduced in the upper region of the reaction space and withdrawn in the lower region whilst the gas is introduced at the bottom of the reaction space in counterflow to the material and is withdrawn at the top.

Such an apparatus, referred to as a counterflow preheater, is used for example for preheating cement raw meal which is then further heated in a furnace, in particular a rotary tubular kiln.

In a known embodiment the funnel-like cross-section constrictions form chambers which have substantially a cylindrical cross-section and are disposed coaxially above each other, the cross-section constrictions then forming in each case open nozzle-like connections between every two superimposed chambers. The fine material introduced from above into each chamber drops downwardly into the region above the cross-section constriction, where it is stemmed by the gas flowing with increased velocity through the cross-section constriction until a limit charge is achieved at which the supporting capacity of the gas flow is no longer adequate, so that the fine material passes rapidly substantially in clouds through the cross-section constriction and thus reaches the next-lower chamber. Beneath the cross-section constriction the fine material clouds disperse in the wide chamber, and the greater part of the material then passes into the region of the funnel-like cross-section constriction of said chamber where it is once again stemmed by the rising gas flow until it drops in again in cloud-like manner into the next-lower chamber. In these operations the fine material comes into intimate contact with the upwardly flowing gas so that an extremely good heat exchange between the material and gas takes place. The fine material preheated in this manner can then be introduced into the following furnace.

Since the material clouds introduced into the next-lower treatment chamber of the reaction space through a cross-section constriction disperse again, the upwardly flowing gas returns part of the introduced fine material through the cross-section constriction into the preceding treatment chanber, so that there is a constant dust circulation between individual chambers of the reaction space. In this manner heat is entrained between the heat exchange stages of the apparatus formed by the individual chambers so that the efficiency thereof is impaired.

SUMMARY OF THE INVENTION

The invention is thus directed to the problem of improving an apparatus of the above-described type so that the dust circulation referred to can be largely avoided by simple means, and the efficiency of the apparatus can be thus increased.

This problem is solved according to the invention in that guide elements for the material are provided on the inner wall of the reaction space in the region of at least one funnel-like cross-section constriction.

In the embodiment according to the invention the arrangement of guide elements combines or bundles the fine material in the region above the cross-section constriction into strand-like configurations of material, so that the fine material passing through the cross-section constriction in strand form, particularly beneath the nozzle-like cross-section constriction, very rapidly leaves the region of elevated gas velocity and moves to a region of reduced gas velocity. In this manner, little or no fine material is entrained by the gas flowing into the higher chamber, considerably reducing the dust circulation between individual chambers of the reaction space, and in turn leading to substantially improved efficiency of the entire apparatus in heat exchange between fine material and gas.

The guide elements on the inner wall of the reaction space or of the chamber may be formed in various manners. Thus, the strand-like configurations of the fine material may be formed for example by simple grooves worked into the inner lining of a chamber.

Preferably, the guide elements are formed of strips, roof-like fittings or pyramid-like fittings, all of said guide element forms being arranged on the inner wall of one of the funnel members which are disposed above the narrowest point of each cross-section constriction.

By corresonding paths of the guide elements, for example from the upper edge to the lower edge of the funnel member, the fine material strands or streaks formed by the guide elements may be deflected with an exactly defined movement through the cross-section contrictions and into the next-lower chamber of the reaction space, so that the fine material held together in a strand-like manner then passes into the upper region of the next-lower chamber in the vicinity of the wall thereof, where a boundary layer of the upwardly flowing gas with reduced flow velocity is disposed. In this manner a further reduction of possible material circulation is ensured.

DESCRIPTION OF THE PREFERRED EMBODIMENTS

Figure 1:
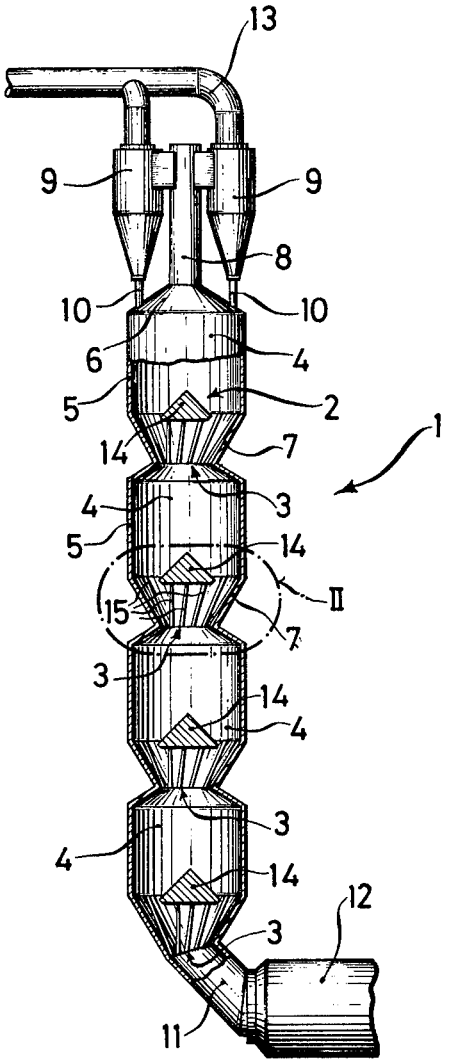
FIG. 1 is a vertical section through a preferred embodiment of a heat exchange apparatus according to the invention.

FIG. 1 shows an apparatus 1 according to the invention constructed as a counterflow heat exchanger for the exchange of heat between fine material and gas. This apparatus comprises substantially a vertical reaction space 2 which is divided by funnel-like cross-section constrictions 3 into 4 chambers 4. Each chamber 4 is defined by a substantially cylindrical wall 5 surrounding the major portion of the chamber, an upwardly frusto-conical tapering cover 6 at the top and a frusto-conical funnel member 7 adjoining the lower edge of the cylindrical wall 5. In this manner each cross-section constriction 3 between two coaxially superimposed chambers 4 is defined on the one hand by the lower funnel member 7 of the upper chamber and on the other by the cover 6 of the lower chamber and, as clearly apparent from the drawings, the cover 6 has a flatter frusto-conical form whilst the funnel portion 7 has a frusto-conical form which is steep enough to ensure satisfactory slipping down of the fine material along the inner wall of said funnel member.

Connected to the uppermost chamber of the reaction space 2 is a shaft 8, of reduced cross-section compared with the diameter of the chambers 4, the upper end of which is connected to two cyclone heat exchangers 9 which are arranged parallel to each other and represent a further heat treatment stage, the material discharge tubes 10 of which open into the cover 6 of the upper chamber 4.

The fine material to be treated is introduced from above via the shaft 8 into the reaction chamber 2, and is withdrawn from the lowermost chamber 4 downwardly via a connecting chute 11 into a following rotary tubular kiln 12. The waste gas coming from the rotary tubular kiln 12 is introduced in counter-flow to the fine material at the bottom of the reaction space 2 (the lowermost chamber 4) and is withdrawn at the top via the shaft 8, the cyclone heat exchangers 9 and their common discharge conduit 13.

Disposed substantially in the upper portion of each funnel member 7 is a central scattering cone 14 by which the fine material or fine material cloud coming from above is dispersed and uniformly distributed over the funnel cross-section. To keep the drawings clear the nature of the mounting of the scattering cone in the chambers is not illustrated (the scattering cones may for example be held by struts or the like which are led to the cylindrical wall 5 or the wall of the funnel member 7).

Figure 2:
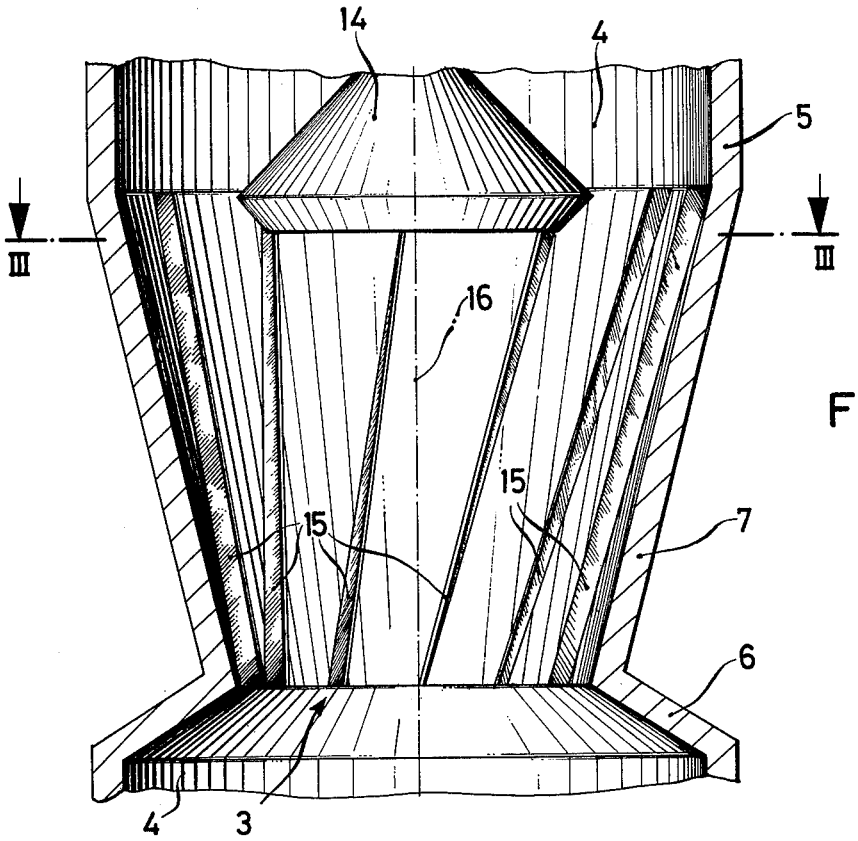
FIG. 2 is an enlarged view of the fragment indicated at II in FIG. 1.

As further clearly apparent from FIG. 2, on the inner wall of each funnel member 7 guide elements 15 are provided for the material. As further explained below with the aid of FIGS. 2 to 5, said guide elements may be formed in various manners; however, in every case these guide elements 15 extend substantially from the upper edge to the lower edge of the funnel member 7, so that they terminate substantially at the narrowest point of each cross-section constriction 3 over which their associated funnel member 7 is disposed.

Figure 3:
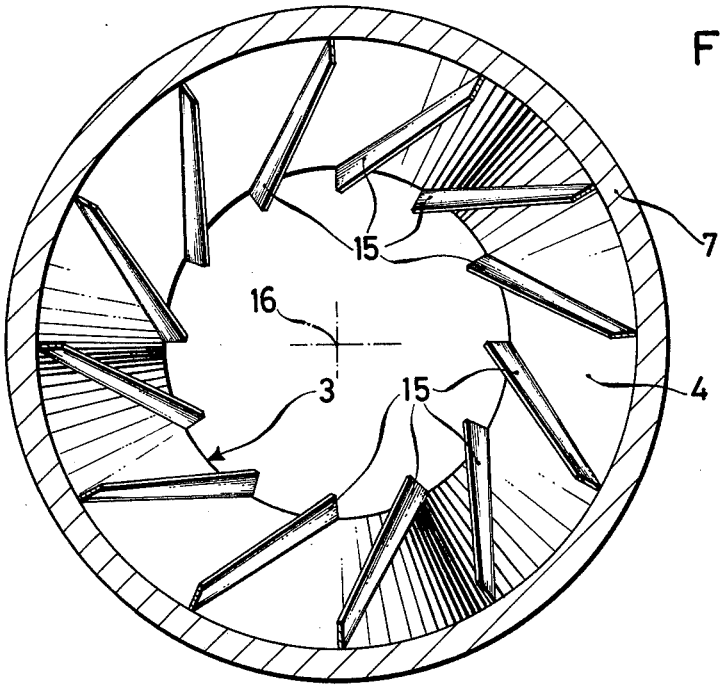
FIG. 3 is a cross-sectional view taken along the line III—III of FIG. 2.

A first embodiment of the guide elements 15 according to the invention is illustrated in FIGS. 2 and 3. The guide elements are formed here as strips 15 which are attached substantially on edge (cf. especially FIG. 3) to the inner wall of the funnel member 7. Said strips 15, which are preferably made from wear-resistant and heat-resistant metal, may, as illustrated, extend substantially inclined to the major axis 16 of the reaction space 2, from the upper edge to the lower edge of the funnel member 7. It is alternatively possible for said strips to extend curved, or slightly helically to the major axis of the reaction space 2, substantially from the upper edge of the funnel member 7 to the lower edge thereof.

Due to the configuration and path of the strips 15, an exactly defined movement of the fine material falling or shooting downwardly through a cross-sectional constriction 3 may be obtained in an extremely favorable manner, so that the fine material rapidly passes in strand or cloud configuration (i.e., not dispersed) through the upper portion of the next-lower chamber 4, in which upward flow of gas at an elevated velocity obtains.

Figure 4:
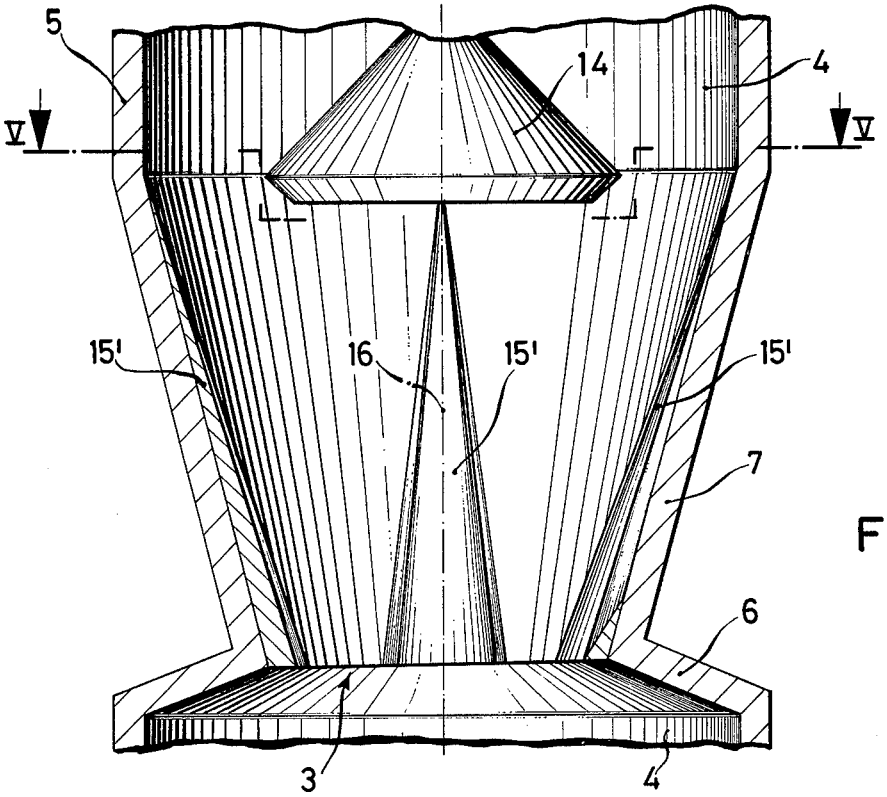
FIG. 4 is a section similar to FIG. 2 but with a different embodiment of the guide elements, taken along the line IV—IV of FIG. 5.
Figure 5:
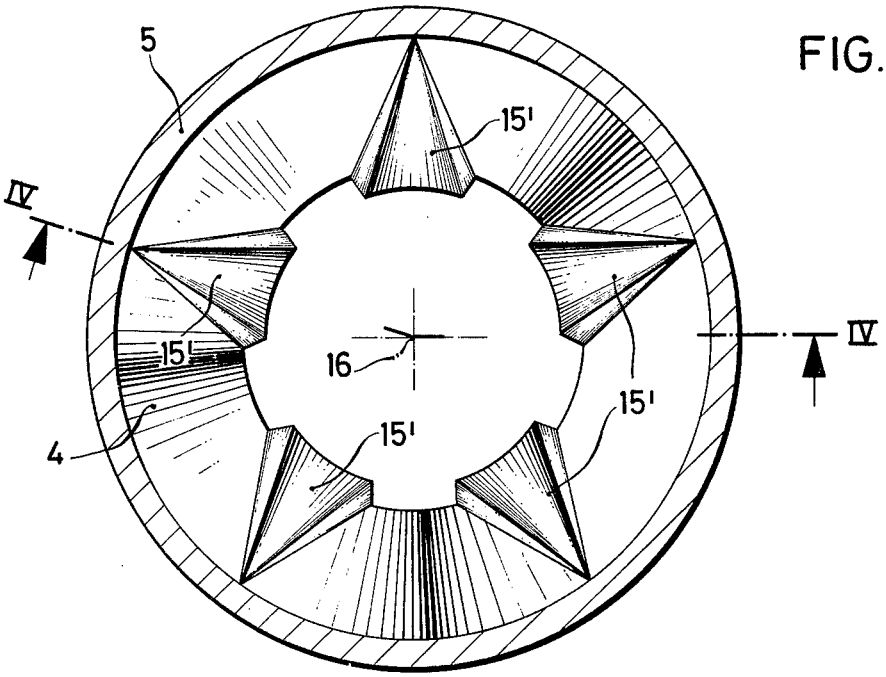
FIG. 5 is a cross-sectional view taken along the line V—V of FIG. 4.

A second embodiment of the guide elements according to the invention on the inner wall of the funnel member 7 is illustrated in FIGS. 4 and 5. In this case the guide elements are formed by pyramid-like fittings 15' which are arranged on the inner wall of each funnel member 7, and which extend substantially from the upper edge to the lower edge of the associated funnel member 7 and become larger gradually both in their thickness (cf. especially fine hatched sectional view of the left side of FIG. 4) and in their width in the direction of the funnel periphery (cf. especially the middle element 15' in FIG. 4).

In a manner similar to the guide elements 15' of FIGS. 4 and 5, the guide elements according to a further embodiment may also be attached as roof-like fittings to the inner wall of each funnel member 7. In this case, the fittings would then have a constant thickness over their entire length, in contrast to those of FIGS. 4 and 5.

In each case the guide elements 15 or 15' are distributed uniformly over the periphery of the funnel member 7.

The guide elements may consist of any suitable heat-resistant and wear-resistant material. It is possible for the guide elements to be formed integrally from the same material as the inner lining of the reaction space 2; alternatively, they may be mounted as separate fittings on the inner wall of the respective funnel member 7. In the latter case, it is advantageously possible for an existing installation to be fitted with guide elements.

Generally, guide elements are provided on the inner wall of each funnel member 7 and thus in each chamber 4; however, for some uses it may be adequate for only the funnel member of one chamber or the funnel member of a few chambers 4 to be provided with guide elements in accordance with the invention.

As clearly apparent from the foregoing, it is essential to the construction of the heat exchange apparatus according to the invention for the fine material slipping downwardly in the region of the cross-section contrictions to be collected substantially in strands and to be passed in this form in definite paths through the nozzle-like cross-section constriction. For this purpose, apart from the preferred guide elements described above and illustrated in the drawings other embodiments of guide elements may be used, such as for example grooves worked into the inner wall of the funnel member, fittings in the form of vertically halved thin cones, etc.

I claim:

1. Counterflow heat exchanger apparatus for heat exchange between fine material and gas, comprising a generally vertical reaction vessel which is divided by funnel-like constrictions into a number of individual chambers and which has at least one inlet for introducing fine material into the top of the uppermost of such chambers and an opening at the bottom of the lowermost of such chambers for withdrawing heated fine material and for introducing hot gas to be exhausted from said uppermost chamber, each individual chamber having a substantially cylindrical portion above a funnel portion, and a central scattering cone at the upper end of each of said funnel portions, wherein the improvement includes guide elements for the fine material extending downward along the inner surface of at least one funnel portion of the chambers, the guide elements being distributed around said inner surface of said at least one funnel portion.

2. Apparatus according to claim 1 wherein the guide elements are in the form of strips which are secured substantially on edge to said inner surface above the narrowest part of said funnel portion.

3. Apparatus according to claim 2 wherein the guide elements extend substantially from the upper end to the lower end of the funnel portion.

4. Apparatus according to claim 2 wherein the guide elements are arranged generally helically relative to the major axis of the vessel.

5. Apparatus according to claim 1 whrein the guide elements are in the form of pyramid-like fittings on said inner surface above the narrowest part of said funnel portion.

6. Apparatus according to claim 5 wherein the guide elements extend substantially from the upper end to the lower end of the funnel portion.

7. Apparatus according to claim 5 wherein the pyramid-like fittings increase both in radial thickness and in arcuate width in the downward direction.

8. Counterflow heat exchanger apparatus for heat exchange between fine material and gas, comprising a generally vertical reaction vessel which is divided by funnel-like constrictions into a number of individual chambers, and which has at least one inlet for introducing fine material into the top of the uppermost of such chambers and an opening at the bottom of the lowermost of such chambers for withdrawing heated fine material and for introducing hot gas to be exhausted from said uppermost chamber, each individual chamber being defined by a substantially cylindrical vertical wall of the reaction vessel surrounding the major portion of the chamber, an upwardly frusto-conical tapering cover at the top of the chamber and a funnel-shaped wall of the reaction vessel adjoining the lower edge of the cylindrical vertical wall of the reaction vessel, said funnel-like constrictions between two coaxially superimposed chambers being defined on the one hand by a lower funnel-shaped wall of an upper chamber and on the other hand by a cover of a lower chamber, a central scattering cone at the upper end of each of said funnel-shaped walls, and guide elements for the fine material extending downwardly along the inner surface of at least one funnel-shaped wall, the guide elements being distributed around said inner surface of said at least one funnel-shaped wall.

* * * * *